US007055179B2

(12) United States Patent
Warner et al.

(10) Patent No.: US 7,055,179 B2
(45) Date of Patent: Jun. 6, 2006

(54) HEADWEAR WITH INTEGRATED ELASTICIZED SWEATBAND

(75) Inventors: Raymond Warner, Union, NJ (US); James King, Union, NJ (US)

(73) Assignee: Poretta A. King-Roberson, Union, NJ (US)

( * ) Notice: Subject to any disclaimer, the term of this patent is extended or adjusted under 35 U.S.C. 154(b) by 115 days.

(21) Appl. No.: 10/107,498

(22) Filed: Mar. 26, 2002

(65) Prior Publication Data

US 2003/0182712 A1 Oct. 2, 2003

(51) Int. Cl.
*A42B 5/00* (2006.01)

(52) U.S. Cl. ..... 2/207; 2/174

(58) Field of Classification Search ..... 2/175.1, 2/184.5, 171, 174, 181, 209.13, 195.6
See application file for complete search history.

(56) References Cited

U.S. PATENT DOCUMENTS

| | | | | | |
|---|---|---|---|---|---|
| 214,458 | A | * | 4/1879 | Rosenbluth | 2/200.1 |
| 344,368 | A | * | 6/1886 | Freschl | 2/181 |
| 978,048 | A | * | 12/1910 | Monoson | 2/181 |
| 991,777 | A | * | 5/1911 | Goodman | 66/171 |
| 1,504,350 | A | * | 8/1924 | Hughes | 2/181 |
| 1,675,864 | A | * | 7/1928 | Pekowsky | 2/181 |
| 1,686,258 | A | * | 10/1928 | Schlesinger | 2/172 |
| 1,907,709 | A | * | 5/1933 | Barrow | 2/171 |
| 1,909,686 | A | * | 5/1933 | Kindall | 2/172 |
| 2,052,123 | A | * | 8/1936 | Adamson | 2/171.04 |
| 3,321,774 | A | * | 5/1967 | Tames | 2/181 |
| 4,980,928 | A | * | 1/1991 | Ellis | 2/88 |
| 5,161,260 | A | | 11/1992 | Reynolds | |
| 5,594,956 | A | * | 1/1997 | Barrientos | 2/207 |
| 5,669,075 | A | * | 9/1997 | Weeks | 2/172 |
| 5,713,076 | A | * | 2/1998 | Davis | 2/4 |
| 5,878,756 | A | * | 3/1999 | Bilodeau | 132/274 |
| 6,018,821 | A | * | 2/2000 | Adams | 2/209.11 |
| 6,115,844 | A | * | 9/2000 | Cho | 2/181 |

* cited by examiner

*Primary Examiner*—Katherine Moran

(57) ABSTRACT

An article of headwear comprising a substantially circular body securably attached and integral with an annular elasticized absorbent sweatband. The body is sized such that, when the sweatband is fitted over the wearer's forehead, the body forms a cap snugly fitting over the wearer's head. The article of headwear may include a tail piece securably attached to and integral with the rear of the sweatband. Alternatively, the tail piece may be continuous with the body. When the tail piece is included and the headwear is worn, the tail piece drapes down the back of the wearer's head to the shoulders, and extends substantially from the rear of one earlobe to the rear of the other earlobe.

11 Claims, 8 Drawing Sheets

HEADWEAR WITH INTEGRATED ELASTICIZED SWEATBAND

FIELD OF THE INVENTION

The present invention relates to a type of headwear or head covering, and more particularly relates to a type of headwear having an integrated elasticized sweatband, that is designed to fit snugly on the wearer's head and to protect the wearer's hair, especially during athletic activity.

DISCUSSION OF THE RELATED ART

The use of headwear or head coverings in athletic activities is known. In addition to protective helmets, one of the most common head coverings is a cap, such as a baseball cap. Also common is the sweattband.

Among the fabric head coverings adapted to fit closely or snugly on the head of the wearer, one of the simplest is the "doo rag." The "rag" generally constitutes a square piece of material adapted to fit on the head of a wearer by knotting the piece at the corners. The knotted piece thus fits on the head of the wearer and covers his or her hair.

A similar head covering is that used generally in conjunction with chemical hair treatments. This head covering, known as a "wave cap," is constructed from a single piece of synthetic fabric shaped generally as a rectangle, with two narrow strips of fabric extending off the front edge. The strips are used to secure the head covering to the wearer's head by tying together behind the head, near the nape of the neck. Similar headwear is known to be used by person, such as painters and welders, who must protect their hair from environmental conditions or debris.

It is also known to incorporate a sweatpad or sweatband into the single piece head covering "wave cap," with the sweatpad being attached to a portion of the front edge of the rectangular piece comprising the head covering prior to its being placed on the head. The sweatpad absorbs perspiration from the head and forehead of the wearer, and also may provide cushioning to the forehead of the wearer from the weight of a cap or hard hat worn thereover.

However, the wearer must expend a certain amount of time to fashion the "wave cap" to be worn snugly on his or her head. This involves both forming the originally rectangular fabric piece into a shape that is convenient for wearing, as well as tying the extending narrow strips sufficiently snugly to secure the desired fit. Notwithstanding that the initial fit is sufficiently snug, the mere wearing of the cap during athletic activity, particularly strenuous athletic activity, invariably will cause the tie to loosen, and the fit to become less snug. This will require additional time by the user to at least re-tie the loose strips, if not also re-form the fabric piece. Almost invariably, this re-forming and re-tying will need to be performed during the course of the athletic activity, thereby diminishing the flow and enjoyment thereof.

Alternatively, should the wearer attempt to forestall the activity-induced loosening of the tie by making the initial fit of the cap especially snug, or tight, the level of tension required on the loose strips to secure the cap sufficiently snugly or tightly likely will be such as causes discomfort to the wearer.

Additionally, the use of a strip-tied cap in conjunction with a sweatpad means that at least some portion of the circumference of the wearer's head at the approximate level of the forehead will not be contacted by the sweat pad, so that perspiration produced therefrom will drip unabated onto the wearer, whether on his or her neck, or onto his or her clothing.

What is needed is an article of headwear that achieves a snug fit on the head of the wearer without requiring adjustment thereby, and that maintains its snug fit on the head of the wearer even during strenuous athletic activity without causing discomfort to the wearer. What also is needed is an article of headwear that achieves a snug fit on the head of the wearer, and that further incorporates a sweatband extending along the entire circumference of the peripheral edge of the headwear, so that, when the headwear is worn, the sweatband covers the entire circumference of the wearer's head at the level approximating the forehead, and perspiration produced by the wearer from whatever portion of the forehead circumference of the wearer's head will be absorbed by the sweatband and not drip onto the wearer or onto his or her clothing.

Accordingly, the present invention provides an article of headwear that achieves a snug fit on the head of the wearer without requiring adjustment thereby, and that maintains its snug fit on the head of the wearer even during strenuous athletic activity without causing discomfort to the wearer. The present invention also provides an article of headwear that achieves a snug fit on the head of the wearer, and that further incorporates a sweatband extending along the entire circumference of the peripheral edge of the headwear, so that, when the headwear is worn, the sweatband covers the entire circumference of the wearer's head at the level approximating the forehead, and perspiration produced by the wearer from whatever portion of the forehead circumference of the wearer's head will be absorbed by the sweatband and not drip onto the wearer or onto his or her clothing.

BRIEF SUMMARY OF THE INVENTION

The article of headwear of the present invention comprises a substantially circular body having inner and outer surfaces and a peripheral edge, and an annular elasticized absorbent sweatband having inner and outer surfaces and top and bottom edges. The outer surface of the body, along a line near the peripheral edge thereof, is securably attached to the inner surface of the sweatband along a line near the top edge thereof, and is integral thereto. The sweatband and body are attached to each other along the entire circumference of the sweatband. The body is sized such that, when the sweatband is fitted over the wearer's forehead, the body forms a cap snugly fitting over the wearer's head.

The body may be comprised of a single substantially circular piece, or may be comprised of two or more pieces fitted together to form the substantially circular body. In a preferred embodiment, the body is comprised of two substantially semicircular pieces, each having a curved peripheral edge and a flat edge. The semicircular pieces are securably attached to each other along the respective flat edges, preferably by stitching, to form the substantially circular body. The body may be made of any suitable material, and preferably is made of nylon fiber.

The sweatband may be any conventional annular absorbent elasticized sweatband with absorbent material along its entire circumference and width and designed to fit snugly on the forehead of a wearer, in addition to absorbing perspiration therefrom. Being elasticized, the sweatband is thus easily adjustable to fit snugly on a wide range of head sizes. The sweatband has no free ends that would need to be secured in order to maintain the snug fit. Accordingly, the sweatband avoids becoming loose during wear, and does not require readjustment. In addition, the sweatband avoids loose ends or attachment hardware (i.e., snaps or hooks), which may flap or otherwise move about during activity by the wearer, thereby causing annoyance and/or discomfort.

In an alternative embodiment, the headwear also includes a tail piece hanging from the rear of the elastic sweatband, opposite that portion contacting the wearer's forehead. The tail piece is substantially trapezoidal and has top and bottom edges and two lateral edges, inner and outer surfaces, a width and a length. The bottom edge of the tail piece may be straight or curved. The outer surface of the tail piece, along a line near the top edge thereof, is securably attached to the inner surface of the elasticized absorbent sweatband along a line near the bottom edge thereof in an area of the sweatband opposite that portion contacting the wearer's forehead during wearing, and is integral thereto. The tail piece is sized such that, when the headwear is worn, the tail piece drapes down the back of the wearer's head to the shoulders, and extends substantially from the rear of one earlobe to the rear of the other earlobe.

The tail piece may be comprised of a single piece, or may be comprised of two or more pieces fitted together to form the substantially trapezoidal tail. In a preferred embodiment, the tail piece is comprised of two pieces, each having a lateral edge and a flat edge. The pieces are securably attached to each other along the respective flat edges, preferably by stitching, to form the substantially trapezoidal tail piece. The tail piece may be made of any suitable material, and preferably is made of nylon fiber.

Alternatively, the tail piece may be continuous with the body and extend therefrom. In this embodiment, the attachment of the sweatband to the body is discontinued for the portion of the body that forms the continuous tail. The tail thus hangs between the wearer's head and the sweatband, allowing for the tail to be pulled as necessary to ensure a snug fit of the headwear.

DETAILED DESCRIPTION OF THE INVENTION

Figure 1:
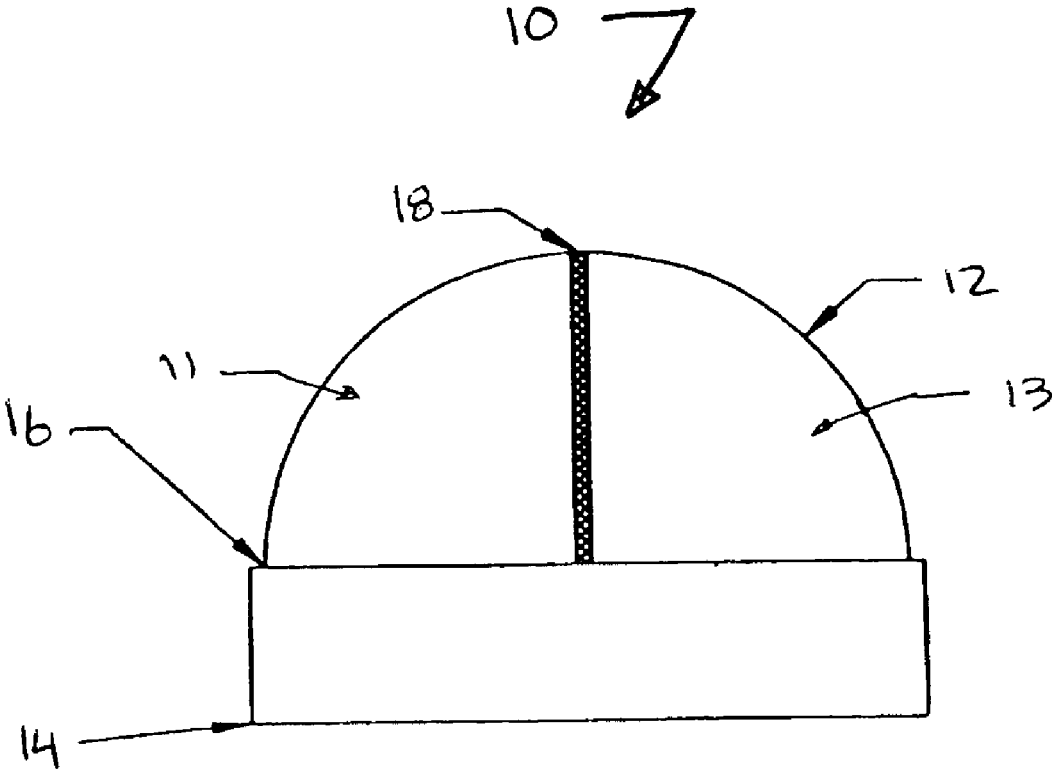
FIG. 1 is a front view of a preferred embodiment of the headwear of the present invention.
Figure 2:
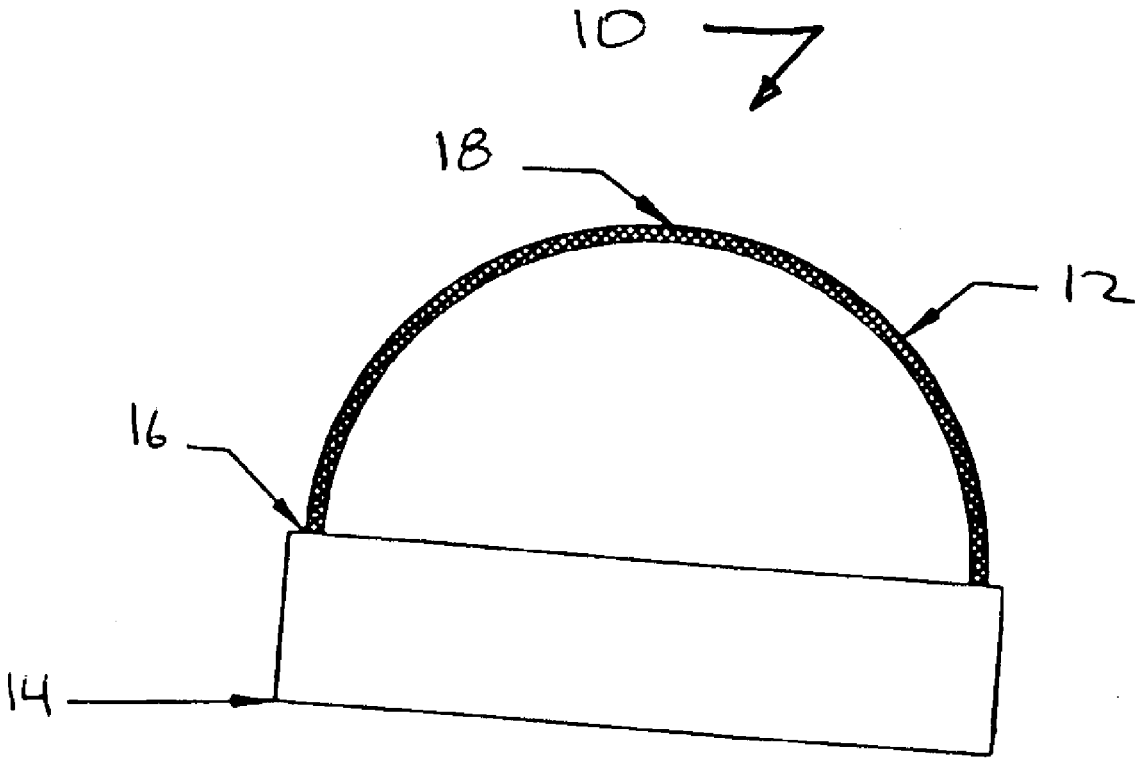
FIG. 2 is a side view of the preferred embodiment of the headwear of the present invention.

Turning to FIGS. 1 and 2, the present invention provides an article of athletic headwear 10 comprising a substantially circular body 12 having inner and outer surfaces and a peripheral edge, and an annular elasticized absorbent sweatband 14 having inner and outer surfaces and top and bottom edges. The outer surface of the body 12, along a line near the peripheral edge thereof, is securably attached to the inner surface of the sweatband 14 along a line 16 near the top edge thereof, and is integral thereto. The attachment of the inner surface of the sweatband 14 to the outer surface of the body 12 is continuous for the entire circumference of the sweatband 14. The body 12 is sized such that, when the sweatband 14 is fitted over the wearer's forehead, the body 12 forms a cap snugly fitting over the wearer's head.

The body 12 may be comprised of a single substantially circular piece, or may be comprised of two or more pieces 11, 13 fitted together to form the substantially circular body. In a preferred embodiment, the body is comprised of two substantially semicircular pieces 11, 13, each having a curved peripheral edge and a flat edge 18. The semicircular pieces 11, 13 are securably attached to each other along the respective flat edges 18, to form the substantially circular body. The semicircular pieces 11,13 may be so secured by any conventional securing means, and preferably are so secured by machine stitching. The body 12 may be made of any suitable material, and preferably is made of nylon fiber.

The sweatband 14 may be any conventional annular absorbent elasticized sweatband including absorbent material along the entire circumference and width thereof and designed to be worn on the head of the wearer at a level approximating the middle of the forehead, and fit snugly thereat, in addition to absorbing perspiration therefrom. The sweatband 14 thus necessarily is a complete annulus, or ring, and has no free ends that would require being secured in order to maintain the sweatband 14 snugly on the head of the wearer. Accordingly, the sweatband 14 avoids becoming loose during wear, and does not require readjustment. In addition, the annular sweatband 14 avoids having loose ends or attachment hardware (i.e., snaps or hooks), which may flap or otherwise move about during activity by the wearer, thereby causing annoyance and/or discomfort thereto.

The sweatband 14 may be securably attached to the body 12 by any conventional means, and preferably is so attached by machine stitching.

Figure 3:
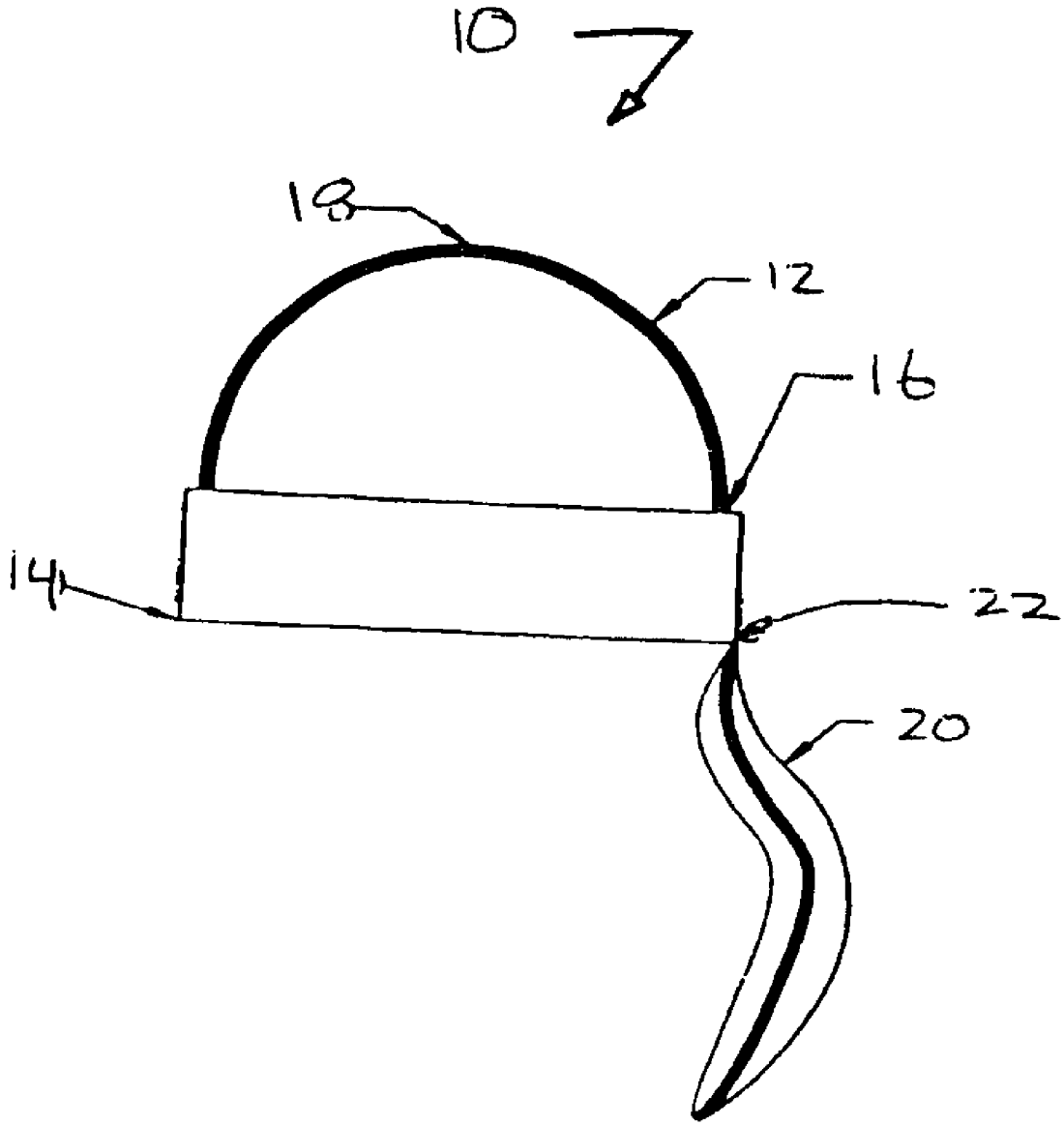
FIG. 3 is a left side view of a further preferred embodiment of the headwear of the present invention.
Figure 4:
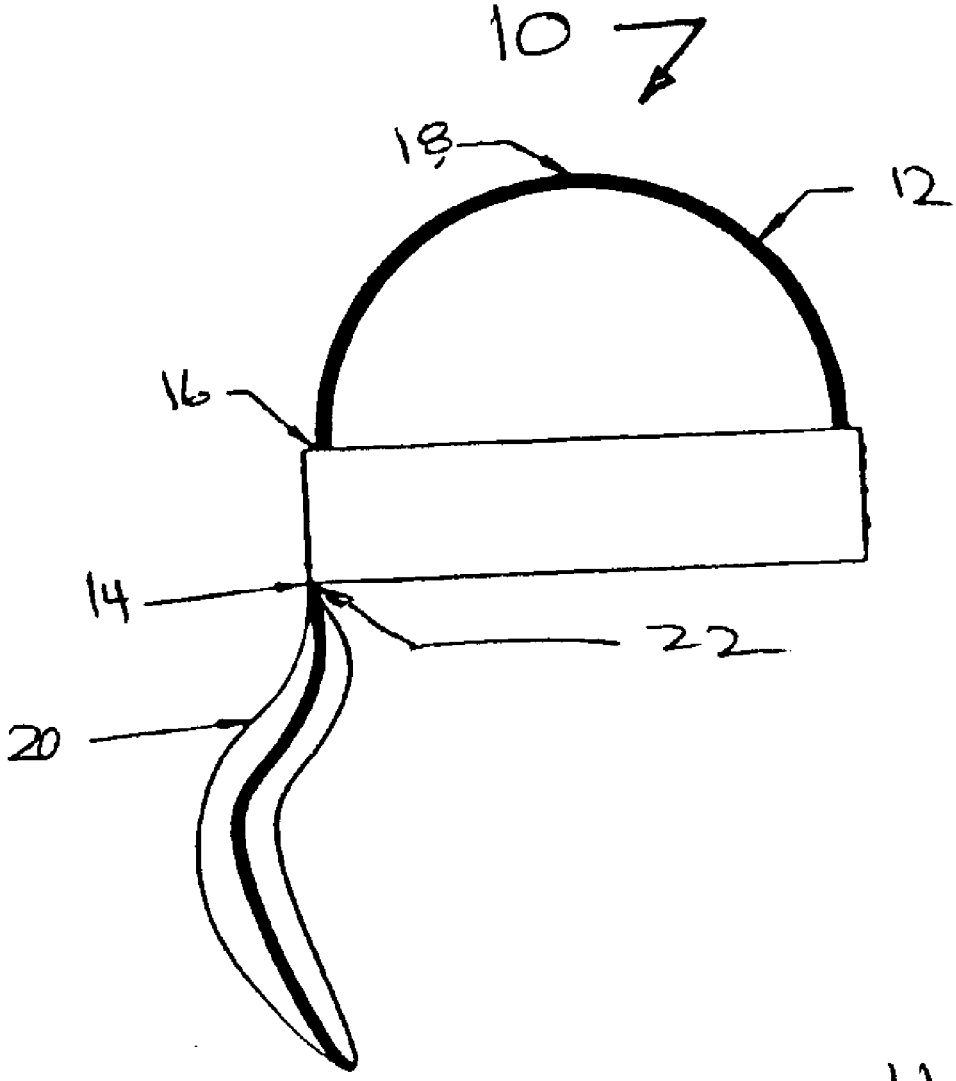
FIG. 4 is a right side view of the further preferred embodiment of the headwear of the present invention.
Figure 5:
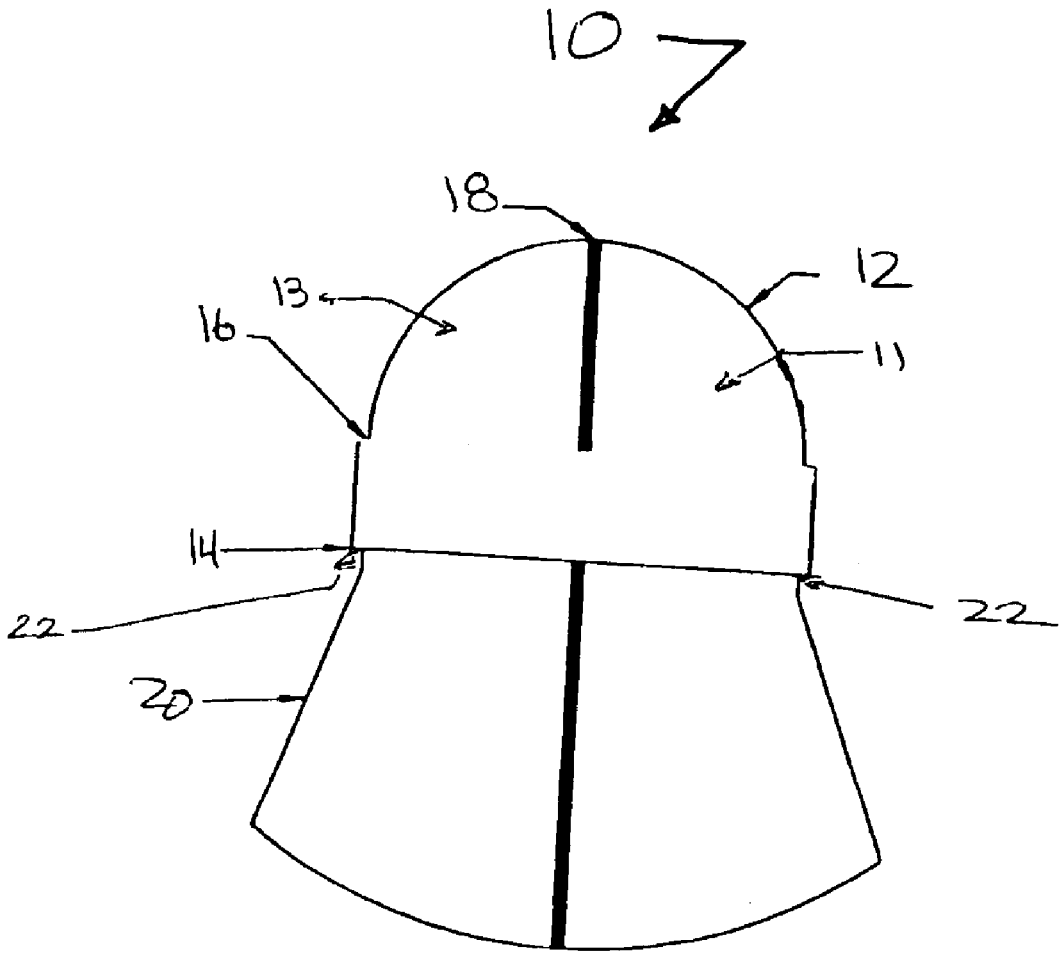
FIG. 5 is a rear view of the further preferred embodiment of the headwear of the present invention.

In an alternative embodiment, as shown in FIGS. 3–5, the headwear 10 may also include a tail piece 20 hanging from the rear of the elastic sweatband 14, opposite that portion contacting the wearer's forehead. The tail piece 20, which in a preferred embodiment is substantially trapezoidal, has top and bottom edges and two lateral edges, inner and outer surfaces, a width and a length. The bottom edge of the tail piece may be straight or curved. The outer surface of the tail piece, along a line near the top edge thereof, is securably attached to the inner surface of the elasticized absorbent sweatband 14 along a line 22 near the bottom edge thereof in an area of the sweatband opposite that portion contacting the wearer's forehead during wearing, and is integral thereto. Attachment may be by any conventional attachment means, and preferably is by machine stitching. The tail piece 20 is sized such that, when the headwear 10 is worn, the tail piece 20 drapes down the back of the wearer's head to the shoulders, and extends substantially from the rear of one earlobe to the rear of the other earlobe.

The tail piece may be comprised of a single piece, or, as shown in FIG. 5 may be comprised of two or more pieces 21, 23 fitted together to form the substantially trapezoidal tail. In a preferred embodiment, the tail piece is comprised of two pieces 21, 23, each having a lateral edge and a flat edge 24. The pieces 21, 23 are securably attached to each other along the respective flat edges 24, to form the substantially trapezoidal tail piece 20. Attachment may be by any conventional means, and preferably is by machine stitching. The tail piece 20 may be made of any suitable material, and preferably is made of nylon fiber. Preferably, the tail piece 20 is made of the same material as the body 12.

Figure 6:
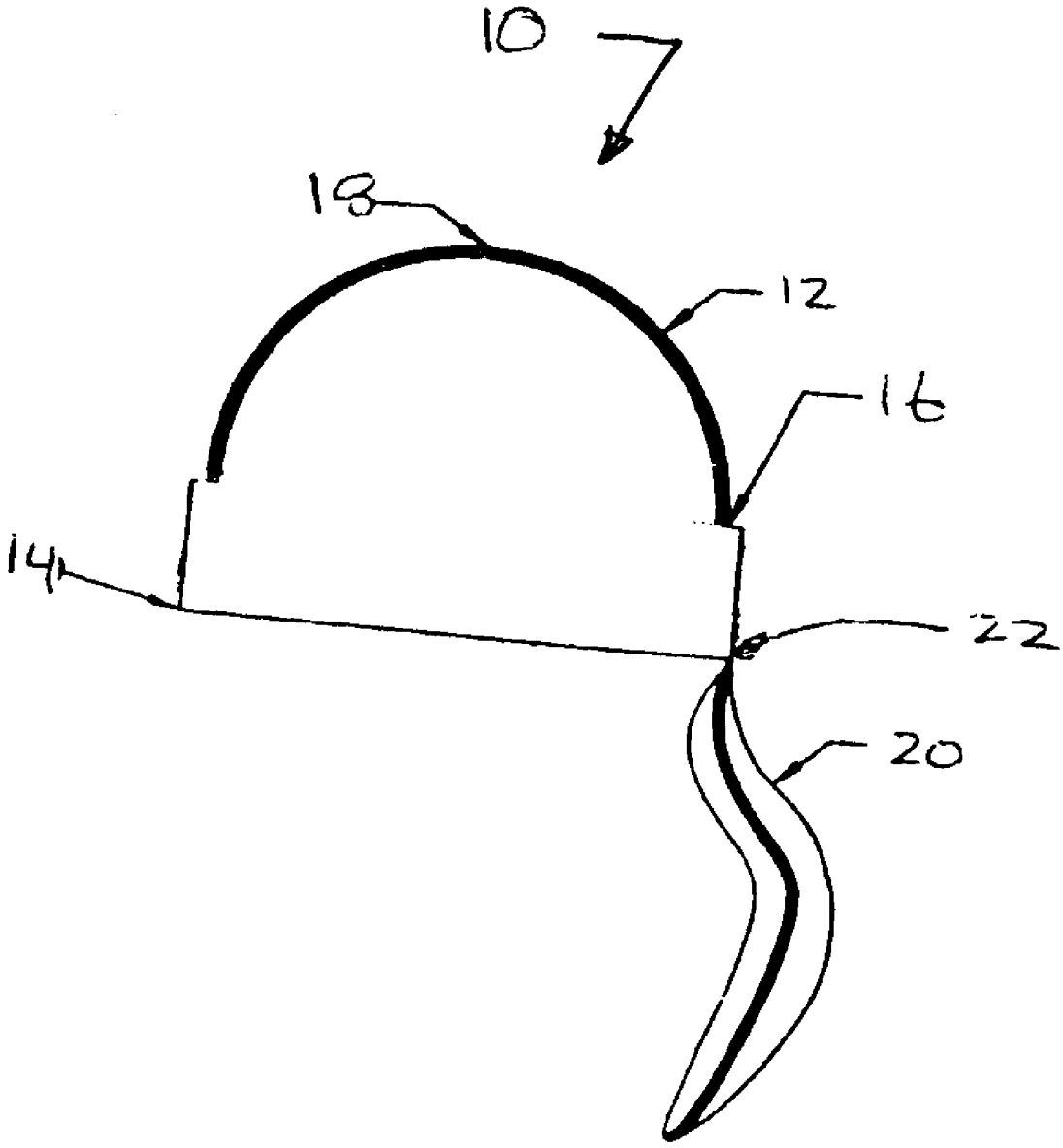
FIG. 6 is a left side view of a further preferred embodiment of the headwear of the present invention.
Figure 7:
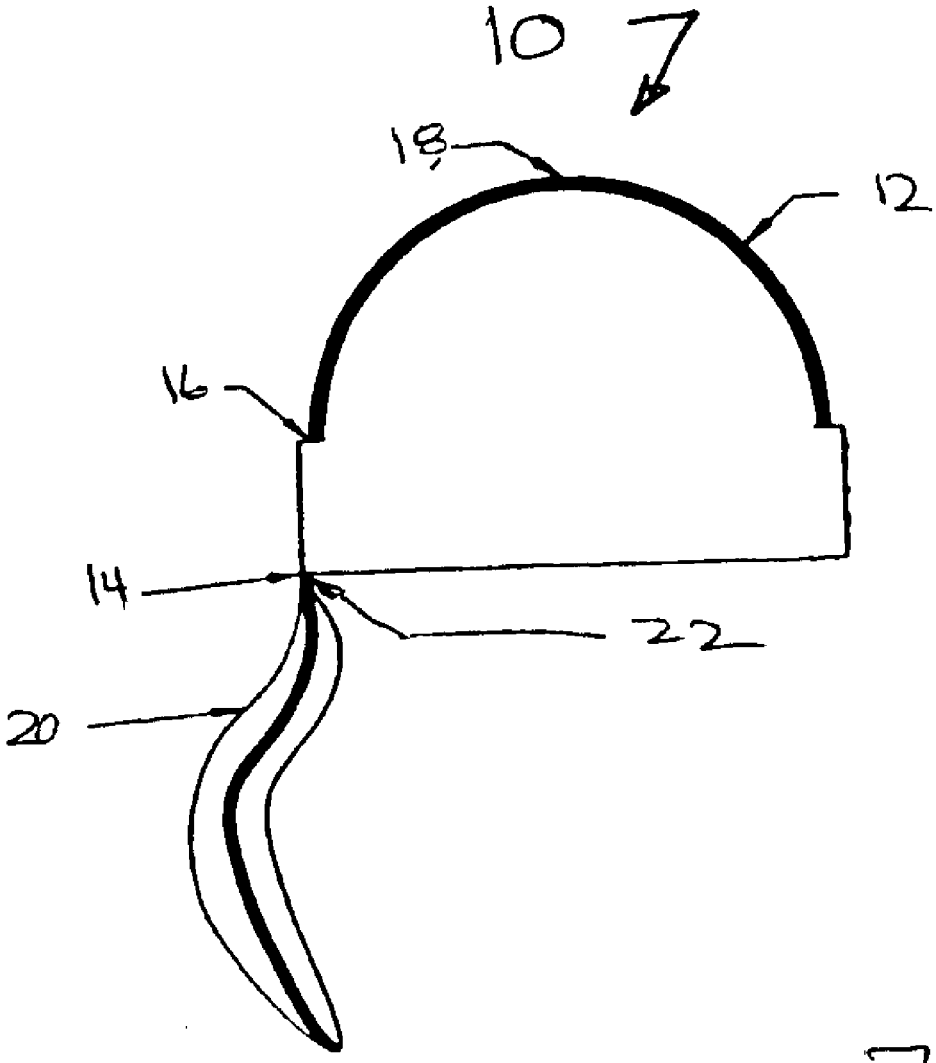
FIG. 7 is a right side view of the further preferred embodiment of the headwear of the present invention.
Figure 8:
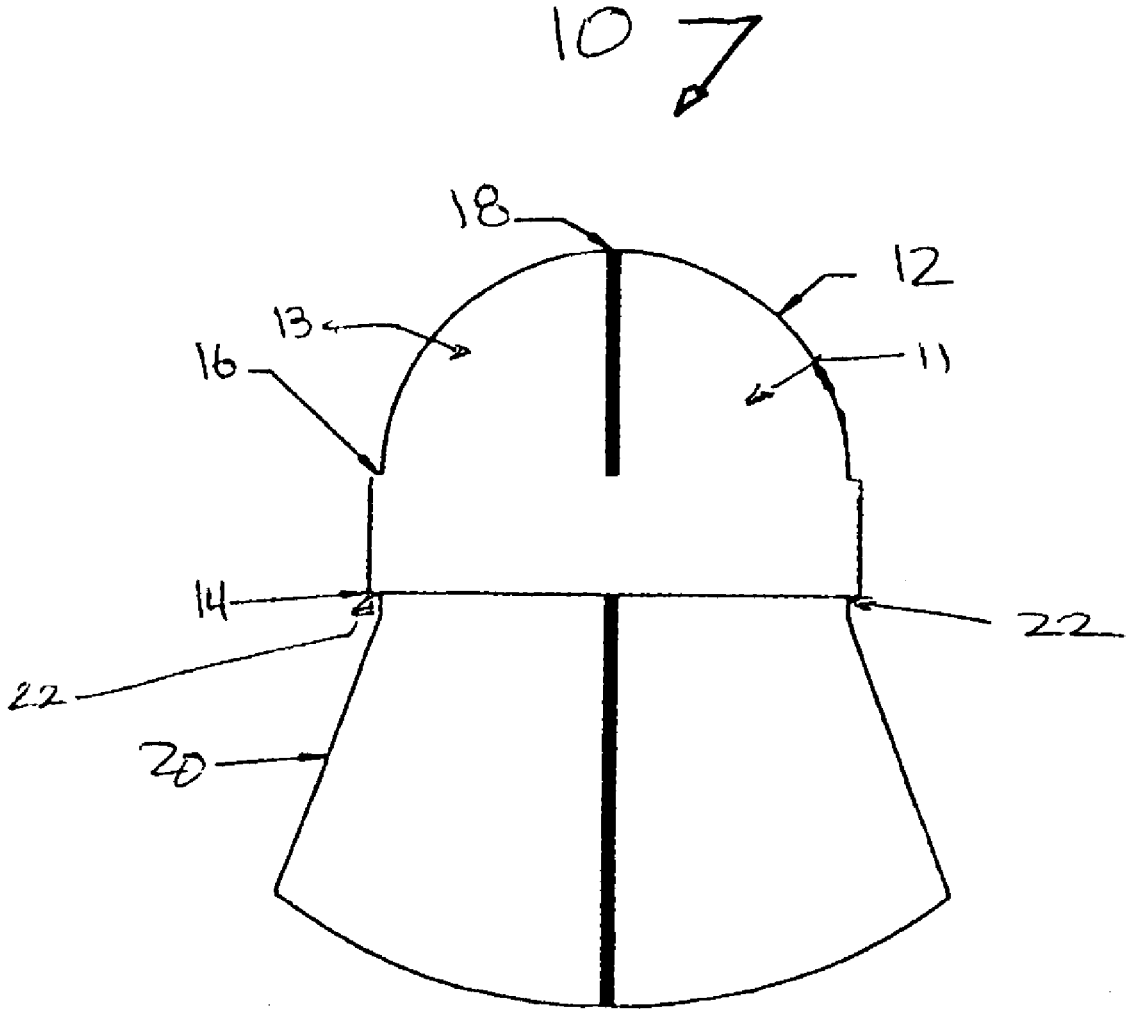
FIG. 8 is a rear view of the further preferred embodiment of the headwear of the present invention.

Alternatively, as shown in FIGS. 6–8, the tail piece 20 may be continuous with the body 12 and extend therefrom. Accordingly, the tail piece 20 is not securably attached to the sweatband 14. Rather, the attachment of the sweatband 14 to the body 12 is discontinued for the portion of the body 12 that forms the continuous tail piece 20. The tail piece 20 thus hangs between the wearer's head and the sweatband 14, allowing for the tail piece 20 to be pulled as necessary to ensure a snug fit of the headwear 10.

In this alternative embodiment, the tail piece 20 is thus comprised of one or two pieces, according to then number of pieces comprising the body 12.

While the invention has been described with respect to certain specific embodiments, it will be appreciated that many modifications and changes may be made by those skilled in the art without departing from the invention It is intended, therefore, by the appended claims to cover all such modifications and changes as may fall within the true spirit and scope of the invention.

What is claimed is:

1. An article of headwear comprising:

a body having inner and outer surfaces and a peripheral edge, and a sweatband that is annular, elasticized and absorbent having absorbent inner and outer surfaces and top and bottom edges, and a secure and integral attachment of the outer surface of the body to the inner surface of the sweatband; the attachment being continuous for an entire circumference of the sweatband; an entirety of the inner and outer surfaces of the sweatband including absorbent material sized to fit snugly over a wearer's head at a level approximating a middle of the wearer's forehead; and the body being sized such that, when the sweatband is fitted over the wearer's forehead, the body forms a cap snugly fitting over the wearers head.

2. The article of headwear of claim 1, wherein the body is formed of a single piece, said piece being substantially circular in shape.

3. The article of headwear of claim 1, wherein the body is formed of a plurality of pieces, said pieces fitting together to form a substantially circular body.

4. The article of headwear of claim 3, wherein the plurality of pieces is two pieces, each piece having a substantially semicircular shape, a peripheral edge, and a flat edge; wherein the two pieces are securably attached to each other along their respective flat edges to form the substantially circular body.

5. The article of headwear of claim 1, wherein the body is formed of nylon fiber.

6. The article of headwear of claim 1, further comprising a tail piece having top and bottom edges and two lateral edges, inner and outer surfaces, a width and a length, the outer surface of the tail piece, is securably attached to the inner surface of the sweatband at a rear of said sweatband; the body is sized such that the tail piece hangs from the elastic sweatband from the rear thereof, and is sized such that, when the headwear is worn on the wearer's head, the tail piece drapes down a back of the wearer's head to approximately shoulder level, and extends substantially from a rear of one earlobe to a rear of another earlobe.

7. The article of headwear of claim 6, wherein the tail piece is formed of a single piece, said piece being substantially trapezoidal in shape.

8. The article of headwear of claim 6, wherein the tail piece is formed of a plurality of pieces, said pieces fitting together to form a substantially trapezoidal tail piece.

9. The article of headwear of claim 8, wherein the plurality of pieces is two pieces, each piece having a lateral edge and a flat edge; wherein the two pieces are securably attached to each other along their respective flat edges to form the substantially trapezoidal tail piece.

10. The article of headwear of claim 6, wherein the tail piece is formed of nylon fiber.

11. An article of headwear comprising:

a body having inner and outer surfaces and a peripheral edge, a tail piece that is continuous with the substantially circular body and extends therefrom at a rear thereof, and an annular elasticized absorbent sweatband having inner and outer surfaces and top and bottom edges, a sweatband that is annular, elasticized and absorbent having absorbent inner and outer surfaces and top and bottom edges, and a secure and integral attachment of the outer surface of the body to the inner surface of the sweatband; the attachment being continuous for an entire circumference of the sweatband; except that the attachment is discontinued for a portion of the body from which the tail piece extends; an entirety of the inner and outer surfaces of the sweatband including absorbent material sized to fit snugly over a wearer's head at a level approximating a middle of the wearer's forehead; and the tail piece hangs from the rear of the body, between the wearer's head and a portion of the elastic sweatband that is not securably attached to the body, and the body being sized such that, when the headwear is worn on the wearer's head, the tail piece drapes down a back of the wearer's head to approximately shoulder level, and extends substantially from a rear of one earlobe to a rear of another earlobe.

* * * * *